US009458995B1

(12) United States Patent
Pearson et al.

(10) Patent No.: US 9,458,995 B1
(45) Date of Patent: Oct. 4, 2016

(54) WIRING RAIL PLATFORM BASED LED LIGHT FIXTURES

(71) Applicant: Tempo Industries, LLC, Irvine, CA (US)

(72) Inventors: Dennis Pearson, Foothill Ranch, CA (US); Michael D. Bremser, Seal Beach, CA (US); James Johnson, Lake Forest, CA (US); Thomas Lueken, Beaumont, CA (US)

(73) Assignee: Tempo Industries, LLC, Irvine, CA (US)

( * ) Notice: Subject to any disclaimer, the term of this patent is extended or adjusted under 35 U.S.C. 154(b) by 0 days.

(21) Appl. No.: 14/750,407

(22) Filed: Jun. 25, 2015

Related U.S. Application Data

(60) Provisional application No. 62/145,786, filed on Apr. 10, 2015.

(51) Int. Cl.

| | |
|---|---|
| ***F21S 4/00*** | (2016.01) |
| ***F21V 21/34*** | (2006.01) |
| ***F21V 23/00*** | (2015.01) |
| ***F21V 29/76*** | (2015.01) |
| ***F21V 19/00*** | (2006.01) |
| ***F21V 21/002*** | (2006.01) |

(52) U.S. Cl.
CPC ..... *F21V 21/34* (2013.01); *F21V 19/0045* (2013.01); *F21V 21/002* (2013.01); *F21V 23/002* (2013.01); *F21V 23/008* (2013.01); *F21V 29/763* (2015.01)

(58) Field of Classification Search
CPC . F21Y 2103/00; F21Y 2101/02; F21V 21/34
USPC ..... 362/221, 219, 225, 249.02
See application file for complete search history.

(56) References Cited

U.S. PATENT DOCUMENTS

| | | | |
|---|---|---|---|
| 3,030,670 | A | 4/1962 | Bigelow |
| 5,620,369 | A | 4/1997 | Spransy et al. |
| 6,351,920 | B1 | 3/2002 | Hopkins et al. |
| 7,726,840 | B2 | 6/2010 | Pearson et al. |
| 8,002,426 | B2 | 8/2011 | Pearson et al. |
| 8,061,870 | B2 | 11/2011 | Pearson et al. |
| 8,398,276 | B2 | 3/2013 | Pearson et al. |
| 9,217,247 | B2 | 12/2015 | Behling et al. |
| 2006/0238136 | A1 | 10/2006 | Johnson, III et al. |
| 2010/0259931 | A1 | 10/2010 | Chemel et al. |
| 2012/0051041 | A1 | 3/2012 | Edmond et al. |
| 2012/0063138 | A1 | 3/2012 | Leadford et al. |

(Continued)

FOREIGN PATENT DOCUMENTS

| | | | |
|---|---|---|---|
| DE | 102009016753 | A1 | 10/2010 |
| DE | 102010001777 | A1 | 8/2011 |

(Continued)

OTHER PUBLICATIONS

EPO 15159756.4 extended European search report, Apr. 12, 2015.

*Primary Examiner* — Vip Patel
(74) *Attorney, Agent, or Firm* — Lapple Ubell IP Law, LLP; Franklin D. Ubell

(57) ABSTRACT

A light fixture apparatus having an LED circuit board mounting platform and an LED driver housing configured to attach to the circuit board mounting platform to form a module which is attachable anywhere along a wiring rail platform.

20 Claims, 20 Drawing Sheets

(56) References Cited

U.S. PATENT DOCUMENTS

| | | | |
|---|---|---|---|
| 2012/0091903 | A1 | 4/2012 | Bembridge et al. |
| 2013/0021792 | A1 | 1/2013 | Snell et al. |
| 2013/0070461 | A1 | 3/2013 | Pickard |
| 2013/0176722 | A1 | 7/2013 | Lay et al. |
| 2013/0208457 | A1 | 8/2013 | Durkee et al. |
| 2013/0208469 | A1 | 8/2013 | Progl |
| 2013/0250567 | A1 | 9/2013 | Edmond et al. |
| 2013/0271979 | A1 | 10/2013 | Pearson et al. |
| 2013/0272000 | A1 | 10/2013 | Pearson et al. |
| 2013/0279165 | A1 | 10/2013 | Pearson et al. |
| 2013/0279179 | A1 | 10/2013 | Pearson et al. |
| 2013/0279180 | A1 | 10/2013 | Pearson et al. |

FOREIGN PATENT DOCUMENTS

| | | | |
|---|---|---|---|
| WO | 2011139764 | A2 | 11/2011 |
| WO | 2012129243 | A1 | 9/2012 |

WIRING RAIL PLATFORM BASED LED LIGHT FIXTURES

RELATED APPLICATIONS

This application claims the benefit of and priority to U.S. Provisional Patent Application Ser. No. 62/145,786, filed Apr. 10, 2015, entitled "Wiring Rail Platform Based LED Light Fixtures," the contents of which is hereby incorporated by reference herein in its entirety.

BACKGROUND OF THE DISCLOSURE

Field of the Disclosure

The subject disclosure relates to wiring rail platform based LED light fixtures and particularly to such a fixture requiring a minimal number of manually inserted fastening devices to assemble a circuit board mounting platform, an LED driver, and a driver housing with one another and with a wiring rail platform.

SUMMARY

In an illustrative embodiment, an LED circuit board mounting platform has first and second slots and a mounting boss formed on an underside thereof, and an LED driver housing has first and second tabs extending from respective inner side surfaces thereof and positioned such that respective feet on opposite lower corners of an LED driver unit snap in or interlock beneath the respective tabs.

The driver housing further has feet formed on an upper vertical edge thereof which are configured to respectively insert into the first and second slots on the underside of the circuit board mounting platform, as well as a tab extending from an inner side surface thereof. The tab has an aperture therein which is positioned such that, after the feet are inserted into the slots, a fastening device is insertable through the aperture and into the mounting boss to thereby attach the driver housing to the circuit board mounting platform.

A wiring rail platform is further provided having first and second side surfaces, which turn inwardly at their upper ends to respectively form a longitudinal rib and a horizontal support surface. Additionally, the wiring rail platform has an angled channel located adjacent the second side surface in an interior portion thereof.

A lower end of a right side of the driver housing has a horizontal groove formed therein which is pivotally engageable with the longitudinal rib, while a lower end of a left side of the driver housing has a flat horizontal surface. To attach the driver housing to the wiring rail platform, the driver housing is positioned at an angle to the platform and the groove and rib are engaged after which the driver housing is pivoted downwardly such that the flat horizontal surface at its lower end rests on the horizontal support surface of the wiring platform, and the groove and rib are interlocked or engaged. Thereafter, fastening devices may be inserted through the right side of the driver housing and into the angled channel of the wiring platform to thereby positively attach the wiring rail platform and driver housing together.

In one embodiment, prior to attaching the driver housing and wiring rail platform together, electrical leads emanating from the LED driver unit are connected to electrical leads running in a channel in the wiring rail platform.

DETAILED DESCRIPTION

Figure 1:
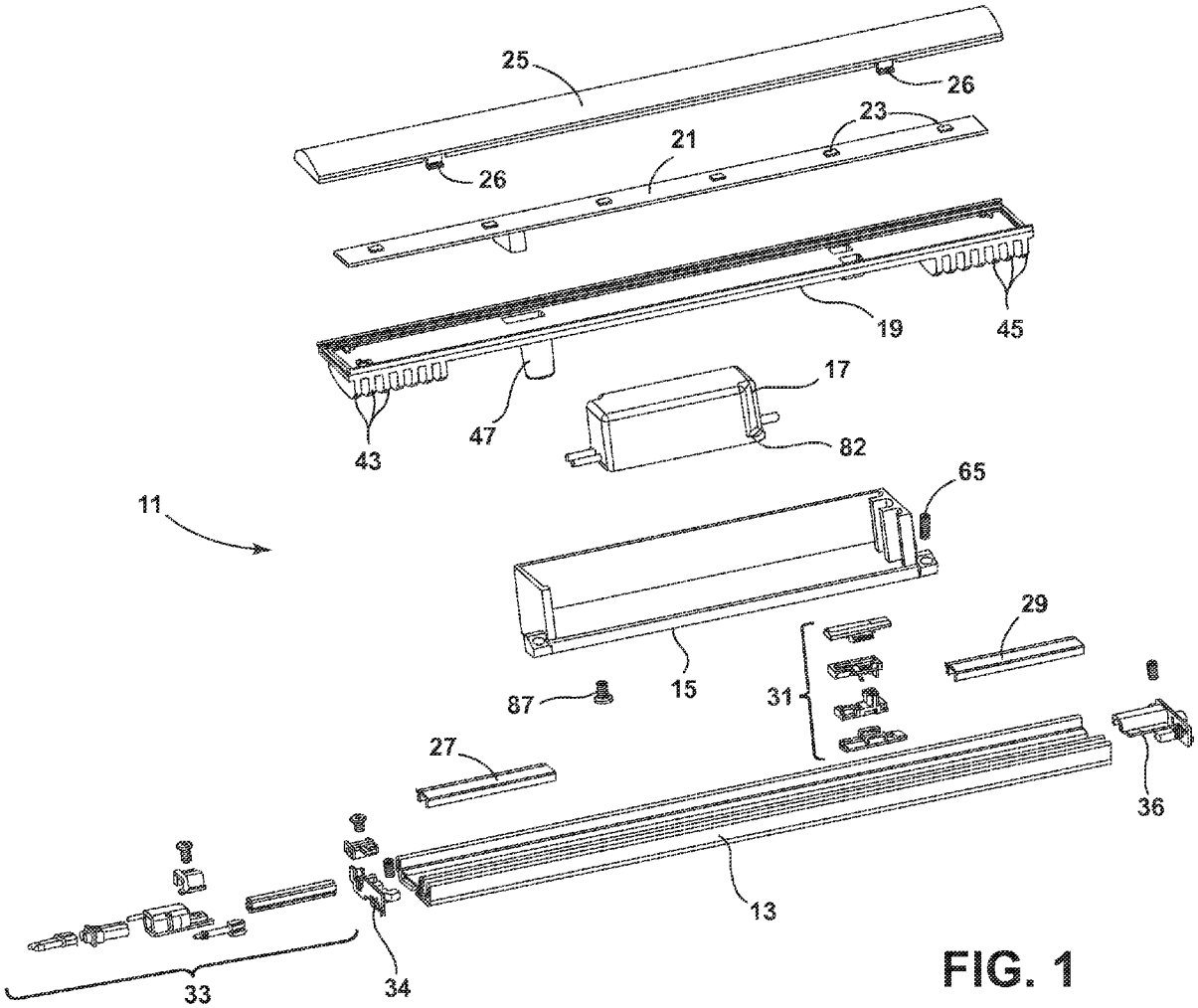
FIG. 1 is an exploded perspective view of a wiring rail platform based LED light fixture according to an illustrative embodiment.

An illustrative LED light fixture apparatus 11 is shown in FIG. 1. The apparatus 11 includes a wiring rail platform 13, a driver housing 15, an LED driver unit 15, an LED circuit board mounting platform 19, an LED circuit board 21, and a lens cover 25. In an illustrative embodiment, the driver mounting bracket housing 15 attaches to the wiring rail 13, and the driver 17 snaps or is otherwise attached within the housing 15. The driver housing 15 attaches to the underside of the circuit board mounting platform 19, while the circuit board 21 and lens 25 attach to the top of the circuit board mounting platform 19. The LED driver unit 15 is arranged to receive an A.C. line voltage and provide D.C. power to one or more LEDs 23 mounted on the LED circuit board 21.

In an illustrative embodiment, the wiring rail platform 13 is an extruded metal material such as aluminum, the driver housing 15 is fabricated of aluminum and the circuit board mounting platform 19 is cast from aluminum. The lens cover 25 may be, for example, a frosted polycarbonate lens. Other suitable materials can of course be used in other embodiments.

In one embodiment, the driver 17 may comprise an M9-U Series AC dimmable LED driver unit by Magtech Industries having an A.C. input and Class 2 D.C. output. In one embodiment, the circuit board 21 may be attached to the platform 19 by thermal adhesive and the lens 25 may be arranged to snap into place using suitable tabs 26 and corresponding apertures in the mounting platform 19.

FIG. 1 further illustrates first and second wireway covers 27, 29 and a pin holder apparatus 31 which serves to transfer power from conductor wires 69, 71 to the LED driver 17. Also shown are male end connector componentry 33 and a male end cap 34 at the left side of FIG. 1 and female end connector componentry 35 and a female end cap 36 at the right side of FIG. 1. In one embodiment, componentry 33 and 35 are connected by continuous electrical conductors suitable for line voltage (120V or 277V) electrical power.

In an illustrative embodiment, the circuit board mounting platform 19 has a generally rectangular depression or channel 41 shaped to receive the LED circuit board 21. Respective semicircular heat sink fins 43, 45 are formed on the underside of the mounting platform 19 at opposite ends thereof. A mounting screw boss 47 also extends downwardly from the underside of the platform 19.

Figure 2:
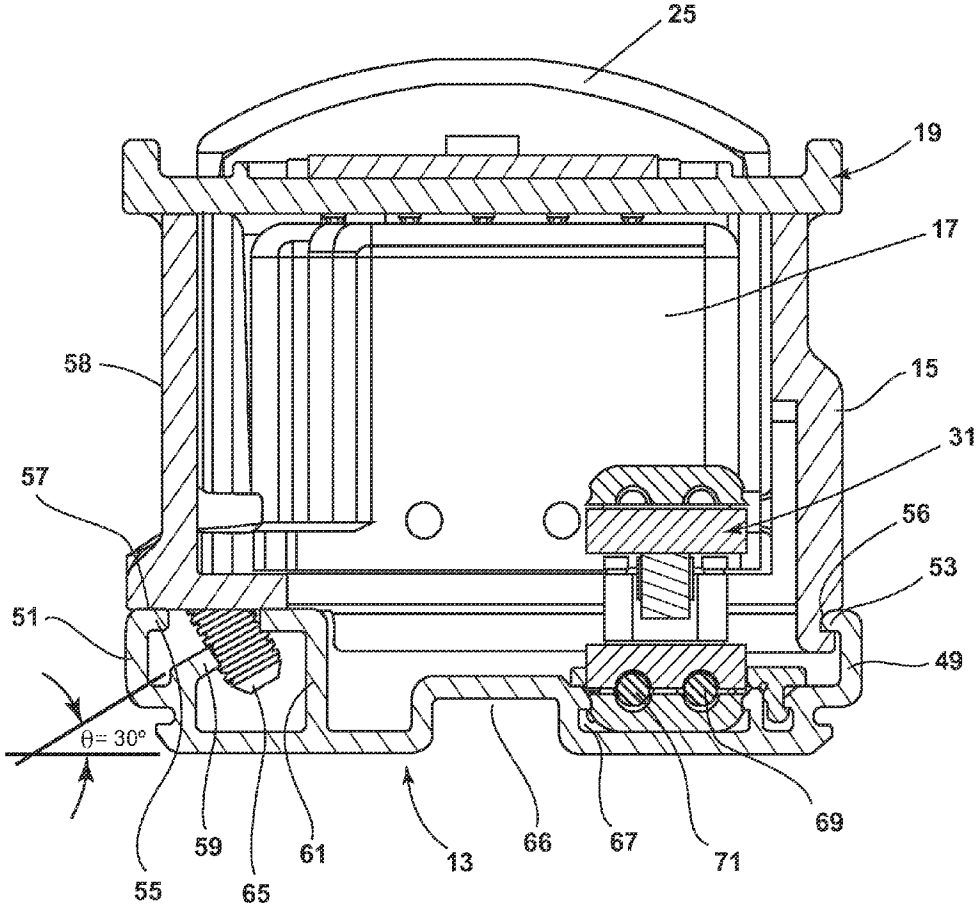
FIG. 2 is a cross-sectional view of the light fixture of FIG. 1 in an assembled state.
Figure 3:
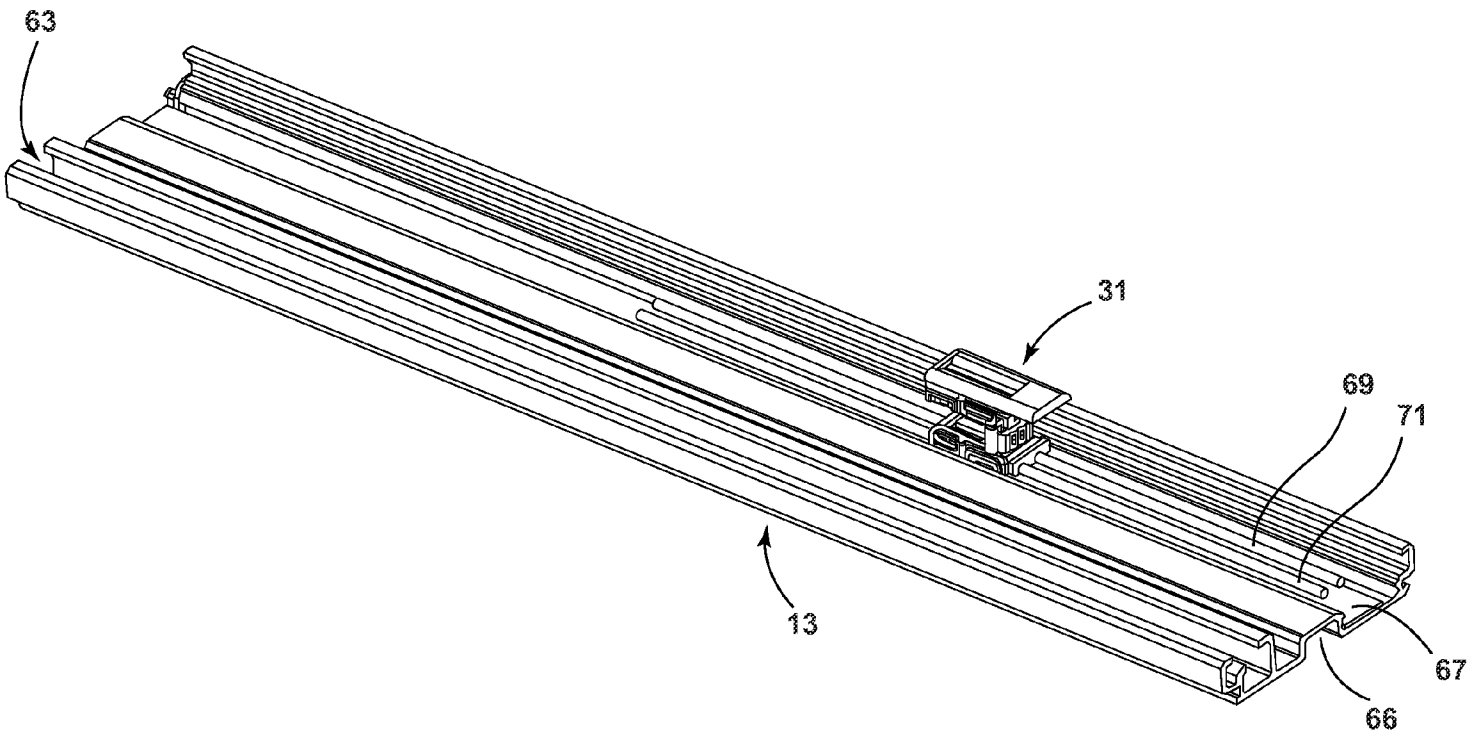
FIG. 3 is a perspective view of a wiring rail platform component of the fixture of FIG. 1.
Figure 4:
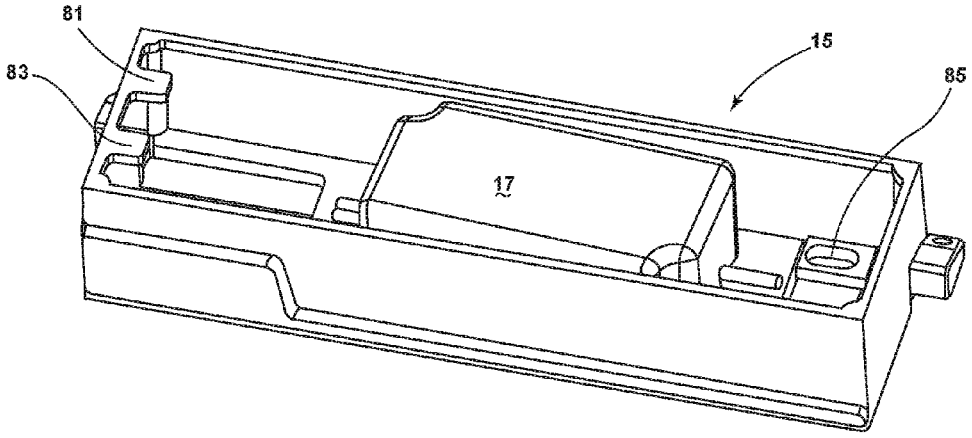
FIG. 4. is a perspective view of driver and driver housing components of the fixture of FIG. 1.
Figure 5:
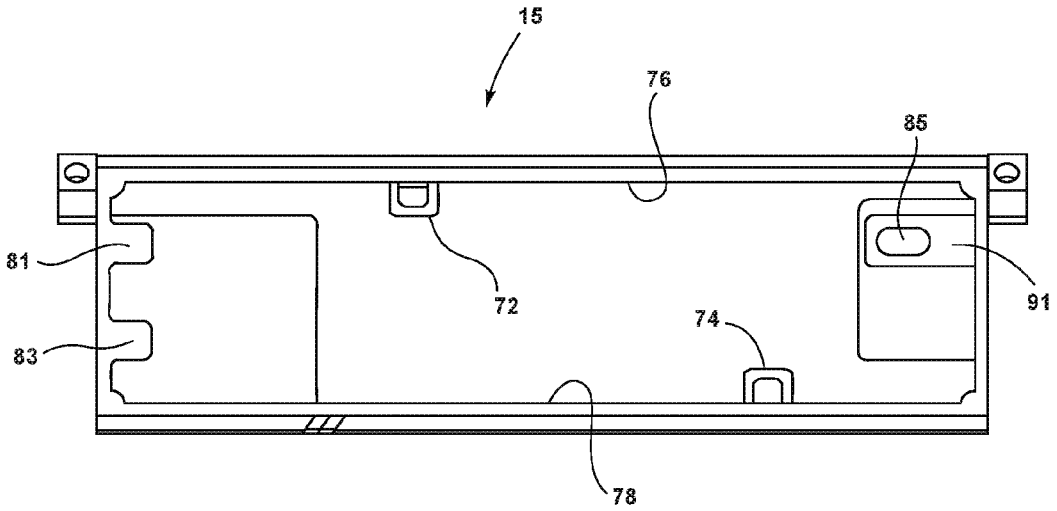
FIG. 5 is a top view of driver housing component of FIG. 4.
Figure 6:
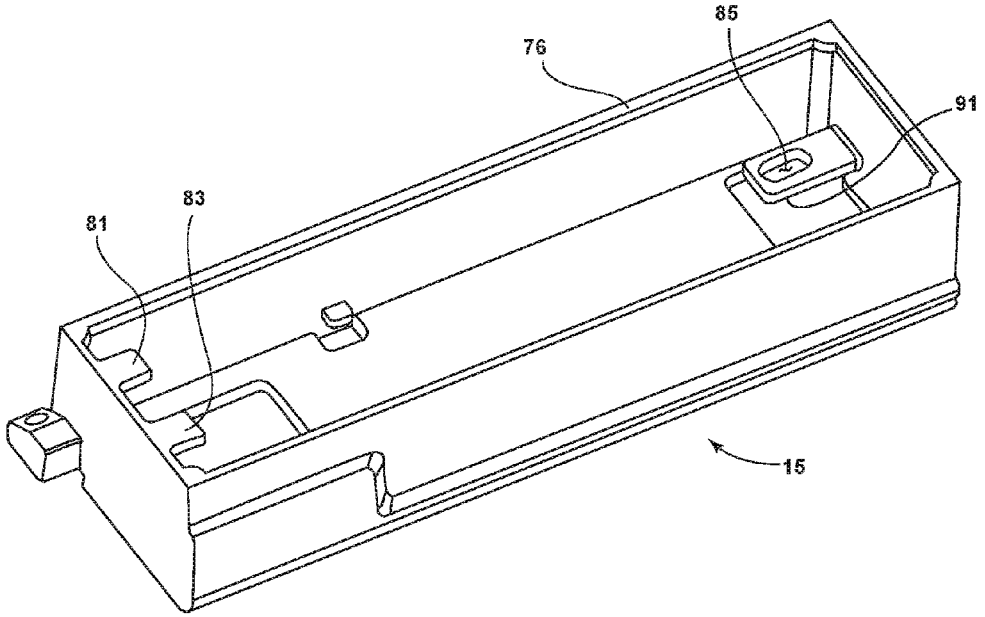
FIG. 6 is a perspective view of the driver housing component of FIG. 4.

As illustrated in FIGS. 2 and 3, the wiring rail platform 13 has respective vertical side surfaces 49, 51, which turn inwardly at their upper ends to respectively form a pivot point 53, and a horizontal support surface 55. As will be discussed below, the lower end of the right side of the driver housing 15 has a groove 56 formed therein which is mountable at pivot point 53 to facilitate attachment of the driver housing 15 to the wiring rail platform 13. A flat horizontal surface 57 is formed at the lower end of the left side 58 of the driver housing 15 and rests on the support surface 55. Respective web members 59, 61 create an angled longitudinal channel 63, which receives a mounting screw 65 to firmly attach the left side of the driver housing 15 to the wiring guide 13. In one embodiment, the angle θ may be 30 degrees.

A longitudinally running wire guide channel 67 is further formed in wiring rail 13 and guides first and second electrical conductor wires 69, 71 through wiring rail platform 13. A channel 66 of rectangular cross-section on the undersurface of the wiring rail platform 13 permits the platform 13 to fit over mounting bracket screws in some embodiments.

Figure 7:
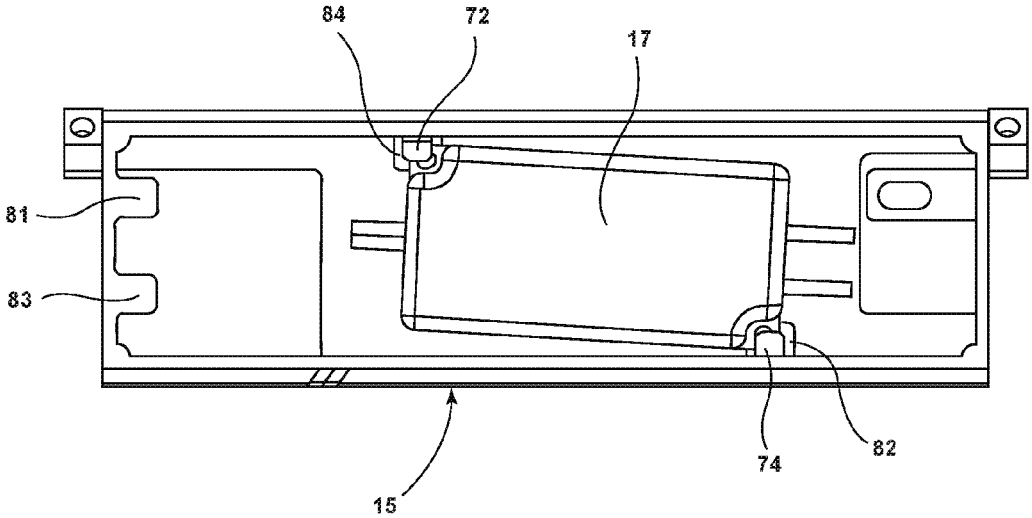
FIG. 7 is a top view of the driver and driver housing component in an assembled state.

FIGS. 4-7 illustrate the manner of attachment of the LED driver unit 17 to the driver housing 15, which is box-shaped and of rectangular cross-section. In one embodiment, first and second tabs 72, 74 are formed extending horizontally from respective vertical inner side surfaces 76, 78 of the driver housing 15 and are positioned such that respective feet 82, 84 on opposite lower corners of the driver 17 snap-in or interlock beneath the respective tabs 72, 74, as shown in FIG. 7.

Figure 8:
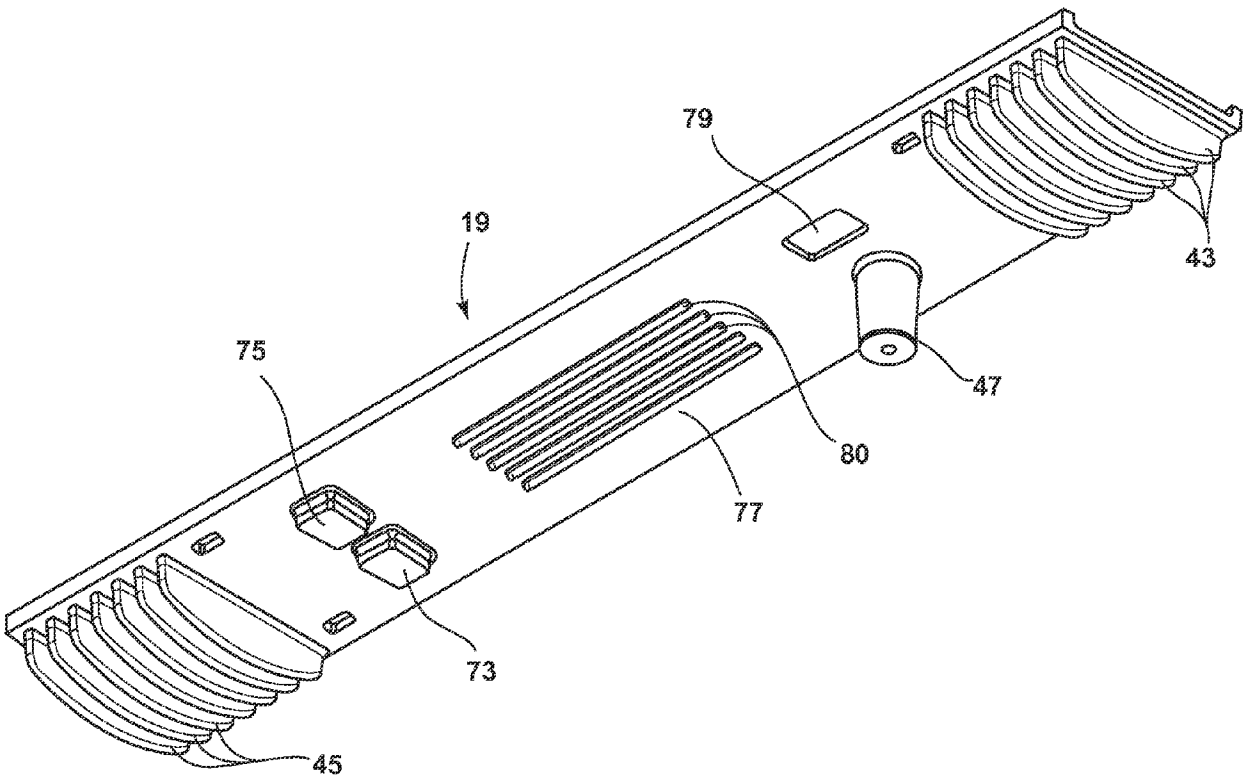
FIG. 8 is a perspective view illustrating the underside of a circuit board mounting platform of the embodiment of FIG. 1.
Figure 9:
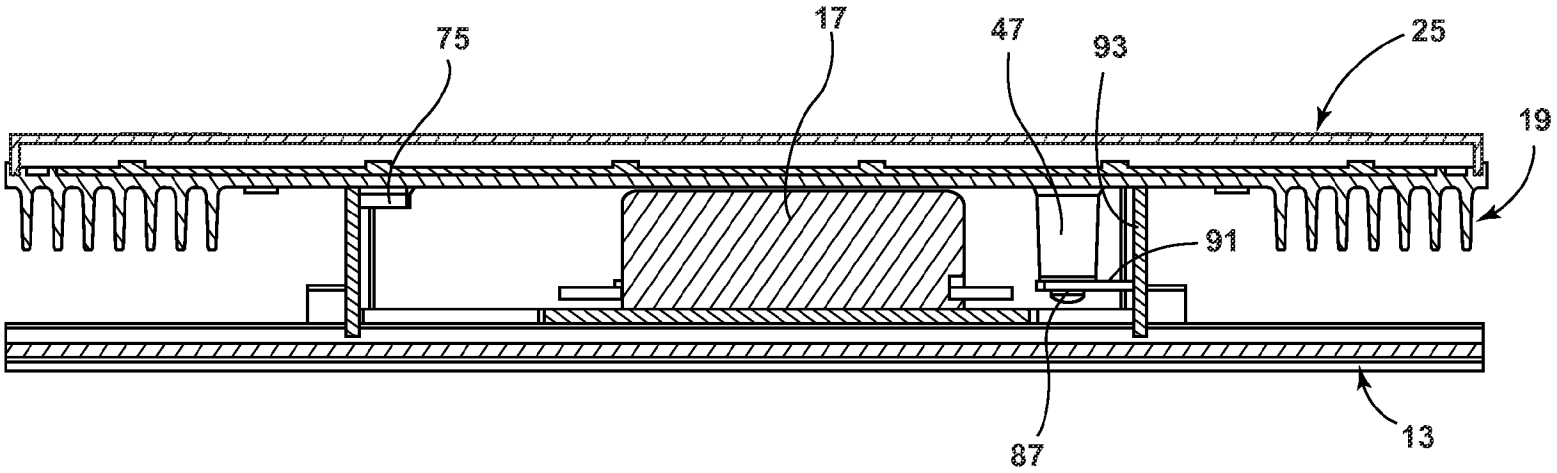
FIG. 9 is a side sectional view of the light fixture apparatus of FIG. 1 in an assembled state.

As shown in FIG. 8, the underside of the circuit board mounting platform 19 has first and second rectangular slots 73, 75 formed thereon. These slots 73, 75 receive mating rectangular feet 81, 83 formed on the upper vertical back edge of driver housing 15 (FIG. 4) to assist in attaching the driver housing 15 to the mounting platform 19. In particular, the feet 81, 83 are respectively inserted into the slots 73, 75 and a mounting screw 87 is inserted through an aperture 85 (FIG. 5) in the driver housing 15 and into the boss 47 of the mounting platform 19, as shown in FIG. 9. The aperture 85 is formed in a tab 91, which extends horizontally from a vertical inner side surface 93 of the driver housing 15.

Figure 10:
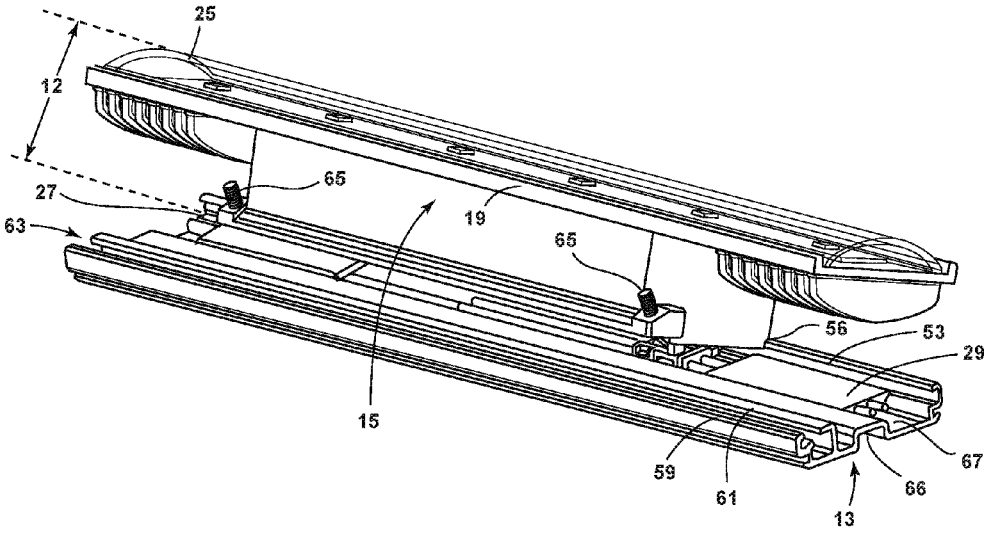
FIG. 10 is a side perspective view illustrating assembly of the light fixture of FIG. 1.

Once the driver 17 and driver housing 15 are attached to the underside of the circuit board mounting platform 19, that subassembly is then attached to the wiring rail platform 13, as further illustrated in FIG. 10. As shown, the groove 56 on the right lower side edge of the driver housing 15 is mated at an angle with the pivot point 53 and then rotated downwardly to establish an interlocking relationship between the lower right edge of the housing 15 and the platform 13. At this point, the driver housing 15 is in the position shown in FIG. 2, and respective mounting screws 65 are then inserted into the channel 63 at opposite ends of the driver housing 15 to firmly hold the assembly together.

Figure 11:
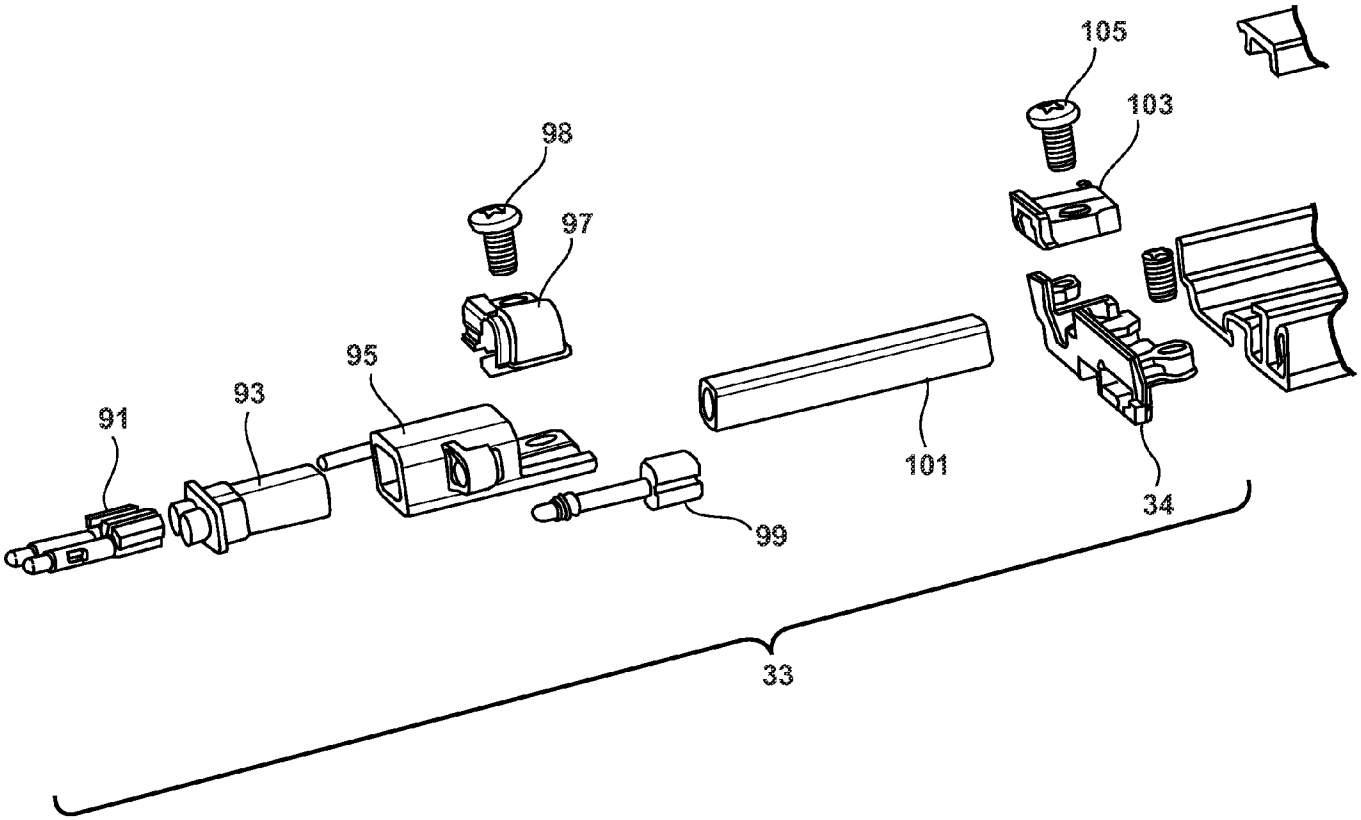
FIG. 11 is a perspective view illustrating male connector componentry of the embodiment of FIG. 1.

FIG. 11 shows an illustrative embodiment of male end connector componentry 33. The components include two male pins 91, a pin holder 93, a male connector housing 95, a conduit connector clamp 97, a conduit 10, a wireway clamp 103, and a male end cap 34. The male endcap 34 holds in place the pin insert 93 which has two male pins 91 residing inside. The conduit 10 is affixed on one end to the male endcap 34 by the wire clamp 103 and on the other end to the male connector housing 95 by the conduit clamp connector 97. This assembly enables interconnection to incoming electrical power or to another fixture of similar type and construction.

Figure 12:
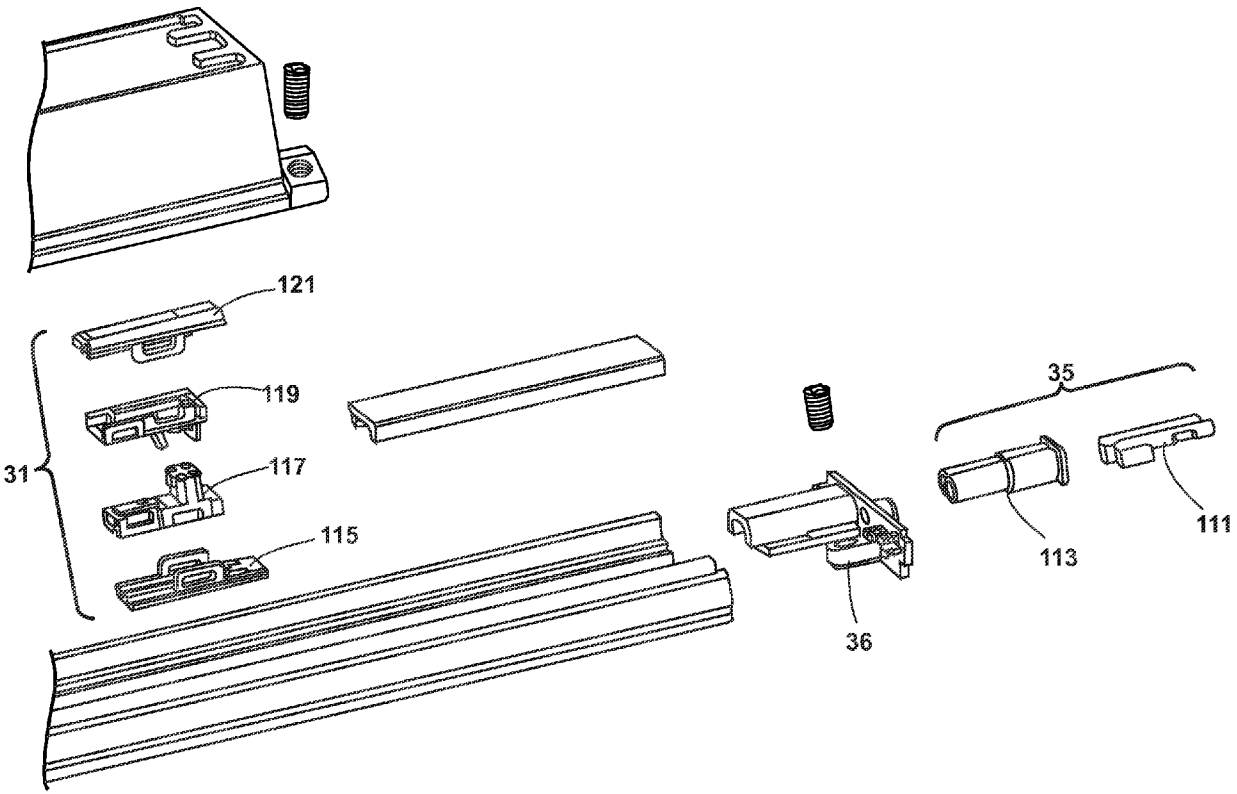
FIG. 12 is a perspective view illustrating female connector componentry of the embodiment of FIG. 1.

FIG. 12 illustrates female end connector componentry 35 according to an illustrative embodiment. Such componentry 35 includes two female electrical receptacles 111 and an insert holder 13. The female end cap 36 is also illustrated. The female electrical receptacles 111 reside in the insert holder 113 which is held in place in the wireway 113 by the female endcap 36 by means of a screw. This assembly enables connection to a male assembly shown in FIG. 11.

Figure 19:
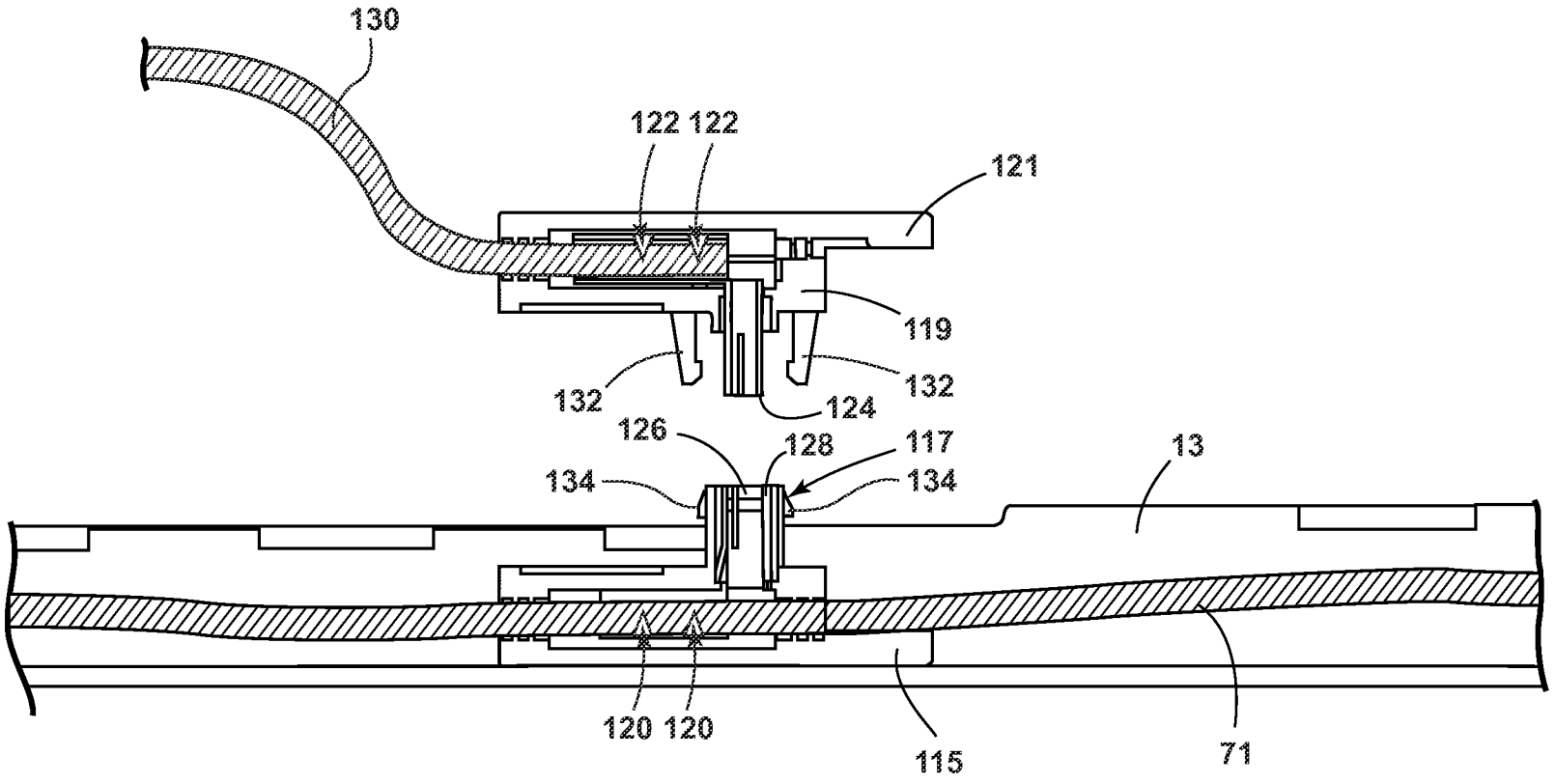
FIG. 19 is a cross-sectional view illustrating electrical connector apparatus employed in an illustrative embodiment.
Figure 20:
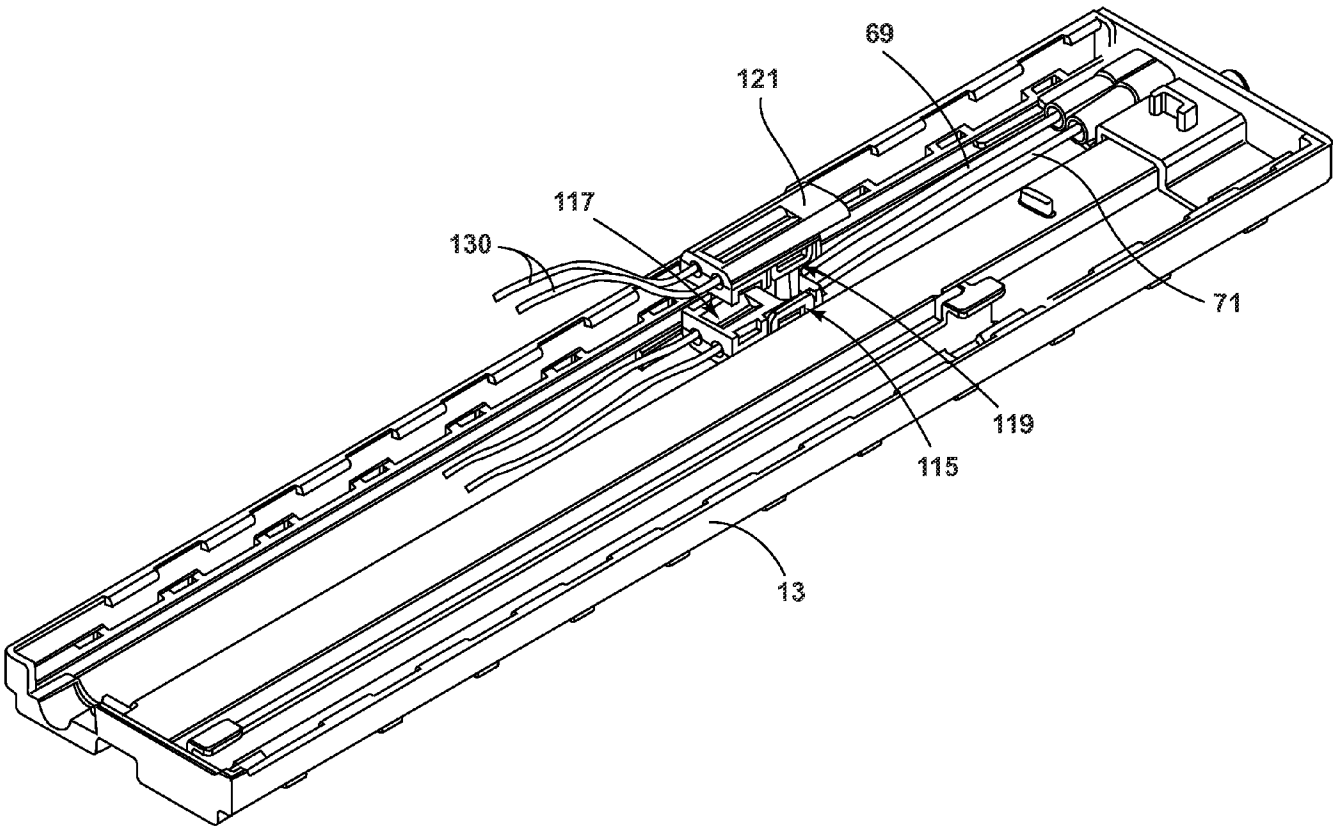
FIG. 20 is a perspective view further illustrating the electrical connector apparatus of FIG. 19.

FIGS. 12 and 19-20 further illustrates the pinholder apparatus 31, which includes a bottom receptacle holder 115, a snap-in female receptacle holder 117, a snap-in male pin holder 119 and a top receptacle holder 121. The bottom receptacle holder 115 works in cooperation with the snap-in female receptacle holder to hold two female electronically conductive insulation piercing pins 120 that are attached to electrical cables running within the wireway 13. Similarly, the top receptacle holder 121 and snap-in male pin holder 119 work in cooperation to hold two male electronically conductive insulation piercing pins 122 which are attached to the input leads of the LED power supply 17.

As illustrated in FIG. 19, a vertically disposed male electrical connector 124 electrically connected to the insulation piercing pins 122 is configured to plug into an opening 126 in a female electrical connector 128 electrically connected to the insulation piercing pins 120 to establish electrical continuity between leads 69, 71 and the leads 130 of to the LED power supply 17. In one embodiment, a snap fit mechanism comprising flexible tabs 132 configured to engage projections 134 may be provided to secure components 117 and 119 together. The illustrative embodiment of FIGS. 12 and 19-20 enables ease of electrical connection and disconnection during manufacturing and repair or replacement of the LED driver 17.

Figure 13:
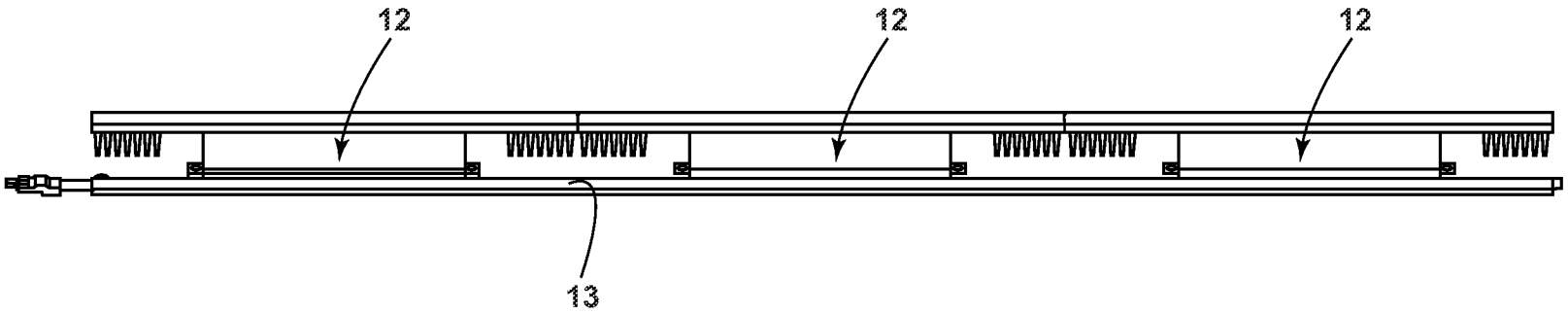
FIG. 13 is a side view illustrating three light fixtures according to FIG. 1 attached to a single wiring rail platform.

In one embodiment, the electrical connectors which establish electrical connection to the conductor wires 69, 71 are arranged such that a module or sub-assembly 12 comprising a circuit board mounting platform 19, circuit board 21, lens 25, driver 17 and driver housing 15 can be connected anywhere along the wiring rail platform 13. The wiring rail platform 13 can be made of any length and any desired number of subassemblies and modules 12 can be attached anywhere along it, providing great flexibility in designing lighting solutions for various applications. FIG. 13 illustrates an embodiment employing three subassemblies 12 attached to a single piece wiring rail platform 13.

In addition, the unique assembly protocol of the apparatus provides great economy and ease of assembly. Feet 81, 83 position the driver housing 15, and a single fastener at an opposite end holds the housing 15 in place. The driver 17 is held in place without any fasteners whatsoever. Units are cheaper to build and replacement of, e.g. subassemblies or "engines" 12, is relatively easy and efficient when compared to prior art.

Ribs 80 on the underside of the mounting platform 19 space the driver 17 away from heat generated by the LEDs 23, providing mechanical support while reducing or minimizing heat transfer. Heat generated by the driver 17 is transferred into the bottom of the driver housing 15. There are two main channels in the wiring rail platform 13—a wire guide 67 on one side and the locking channel 63 in the other.

Figure 14:
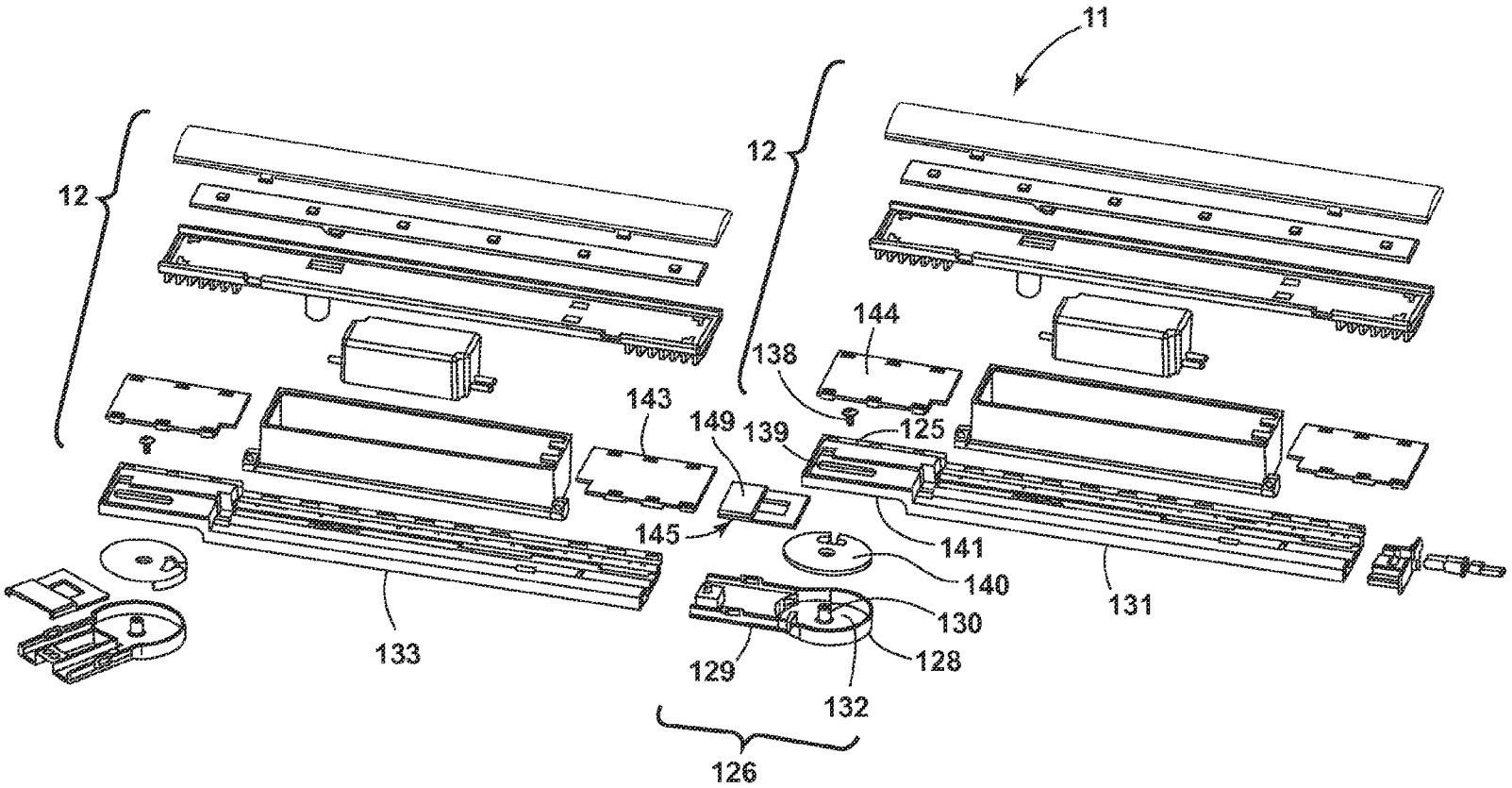
FIG. 14 is an exploded view of an alternate serpentine embodiment employing the illustrative LED light fixture sub-assemblies described in connection with the embodiment of FIG. 1.

FIG. 14 illustrates a serpentine modular construction which embodies advantages of the illustrative embodiment discussed in conjunction with FIGS. 1-13. In particular, sub-assemblies or engines 12 are mounted to wiring rail platforms 131, 133, which are constructed to attach to the subassemblies 12 in the same manner as wiring rail platform 13 of the embodiment of FIGS. 1-13.

An interconnection mechanism or component 126 is positioned beneath an inner end 125 of the right-most wiring platform 131 of FIG. 14. The interconnection component 126 includes a generally cylindrical pivoting interconnection portion or component 128 and an interconnecting tongue portion or component 129. In one illustrative embodiment, the tongue 129 and cylindrical portion 128 are formed as single unitary component, for example, formed of die-cast aluminum, a zinc alloy such as ZAMAK 3, plastic, or other material. The cylindrical portion 128 has a cylindrical male projection or boss 130 formed on its floor 132. A wire cover disc 140 fits over boss 130 and is positioned between cylindrical portion 128 and an underside 141 of the wiring platform 131.

A screw 138 passes through a slot 139 and wire cover disc 140 into the boss 130 of the cylindrical portion 128 of the interconnection mechanism 126 so as to pivotally mount the wiring platform 131 with respect to the interconnection component or mechanism 126. In one embodiment, the depth of insertion of the screw 138 is controlled to enable such pivotal movement. Furthermore, the electrical power wires 67, 69 are routed through a slot 148 in disc 140 to enable rotation of assembly 126 when attached to wiring platform 131.

Figure 15:
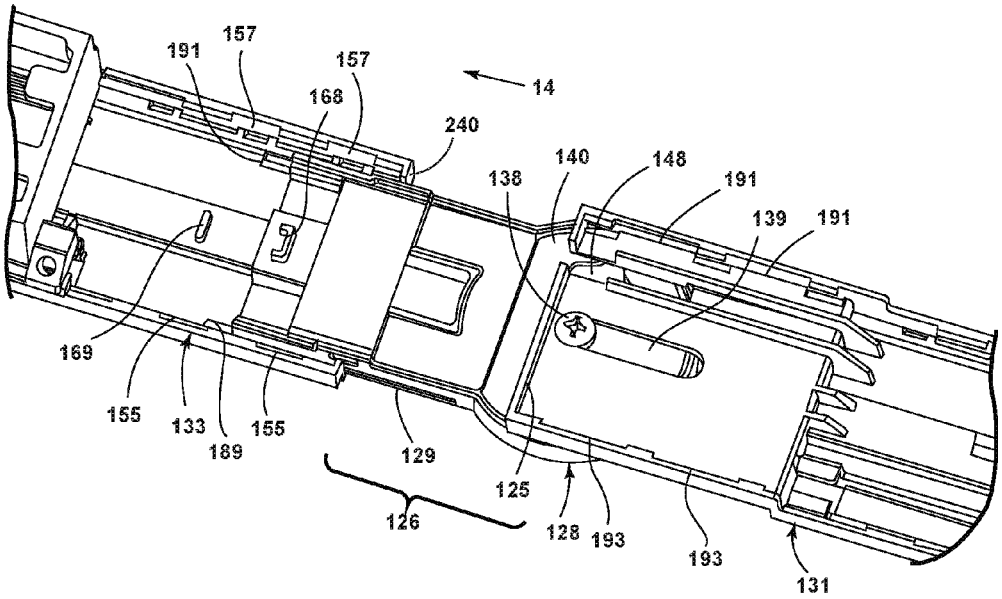
FIG. 15 is a partial perspective view of an extendable pivoting interconnection mechanism of an illustrative embodiment of FIG. 14.

In one embodiment, as shown in FIG. 15, the inner end 240 of the adjacent left-most wiring platform 133 and the tongue 129 are designed such that the tongue 129 slidingly mates with the end 240, such that the tongue 129 may move or slide horizontally into the left-most platform 133 in the direction of the arrow 14 to a point where the tongue 129 is largely concealed. Similarly, the tongue 129 may slide horizontally out of the left-most base 133 to separate the units or modules 11 and extend their overall length.

Figure 16:
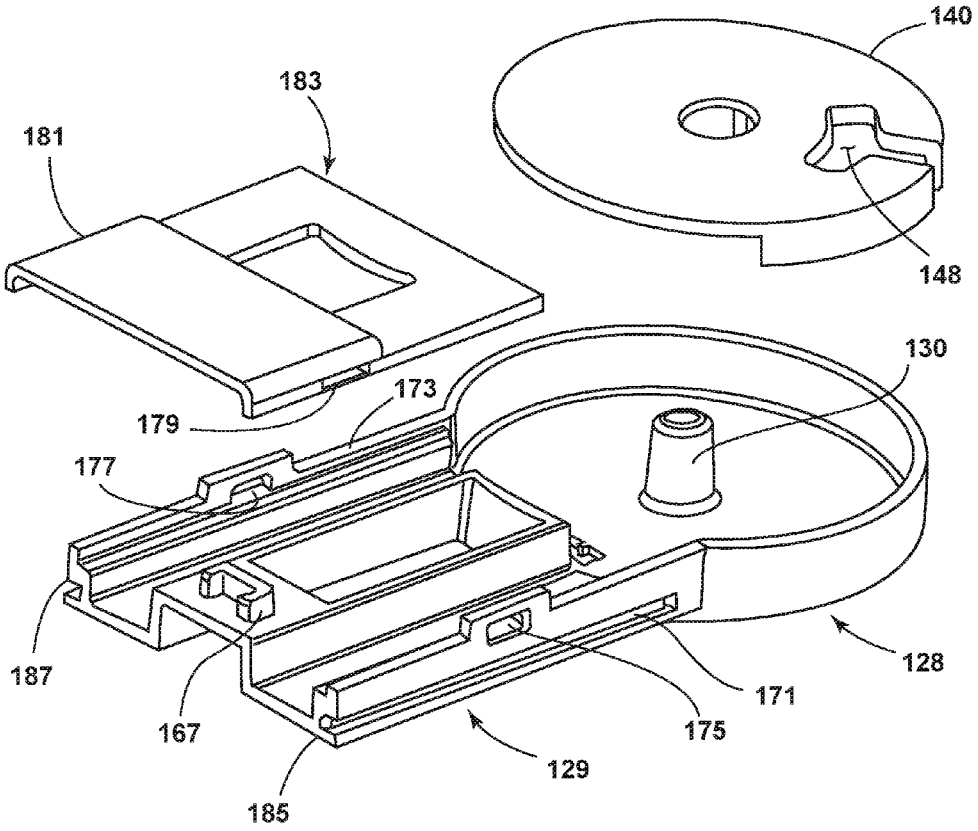
FIG. 16 is an exploded perspective view of component of FIG. 15.

As shown in FIG. 16, the tongue portion 129 has first and second vertical side rails 171, 173, with slots 175, 177 formed respectively thereon. The slots receive tabs 179, 181 on respective sides of a wireway cover 183 such that cover 183 can snap fit onto the tongue 129. Respective longitudinal slots 185, 187 are formed at the lower edges of the vertical side rails 171, 173. These slots 185, 187 slidingly engage mating ribs 189, 191 on the inner side surface of wiring platform 133, which mating restrains the tongue 129 from moving or disengaging vertically with respect to the platform 133.

Figure 17:
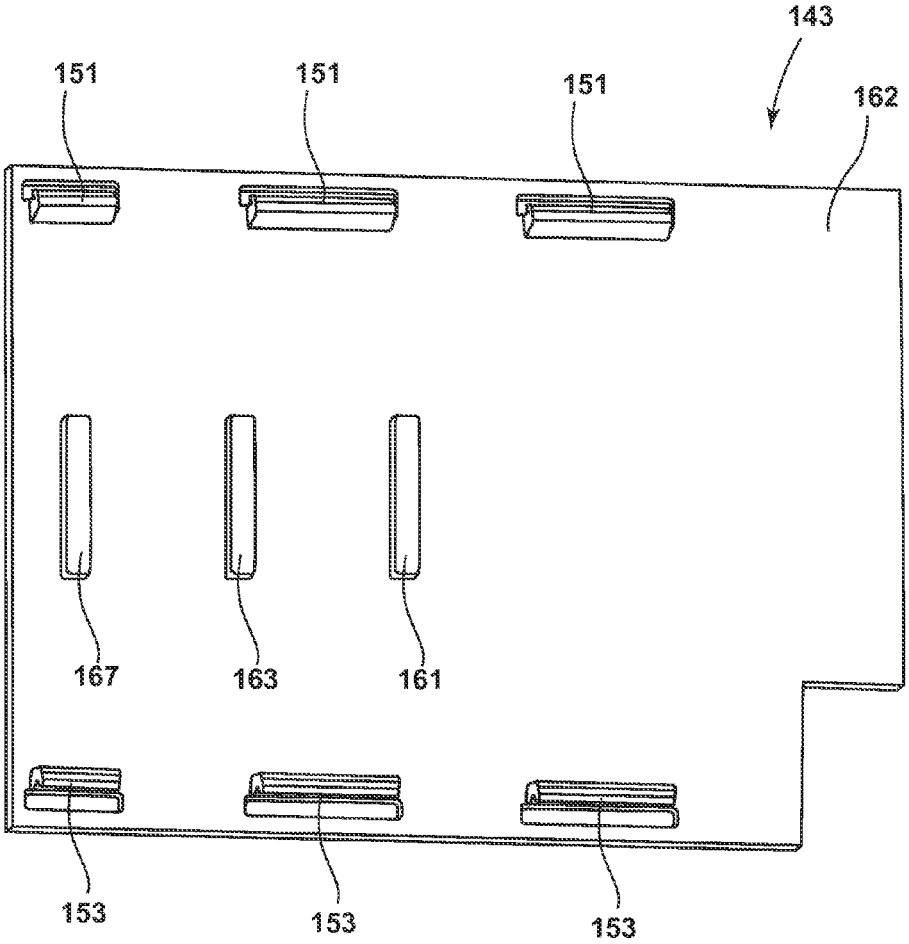
FIG. 17 is a bottom view of a rear end cap componentry of the embodiment of FIG. 14.
Figure 18:
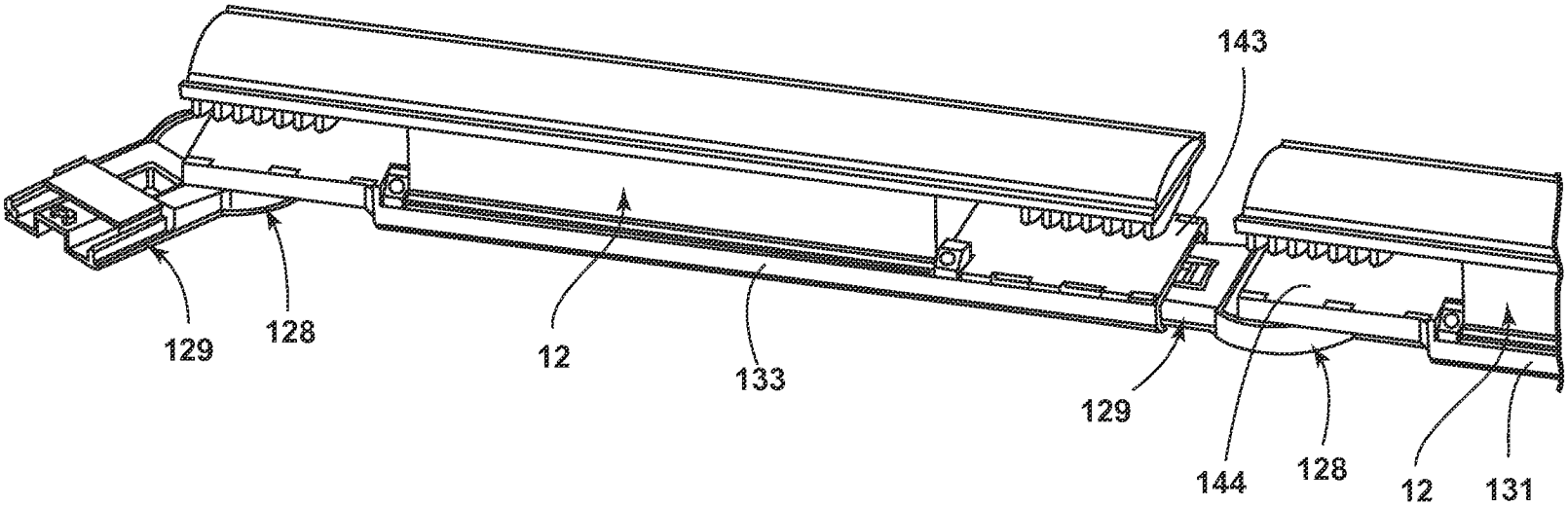
FIG. 18 is a perspective view of the serpentine platform in the assembled state.

As shown in FIG. 17, a rear end cap 143 has respective tabs 151, 153 disposed along respective underside edges, which are configured to enable the end cap 143 to snap into respective slots 157, 155 on respective sides of the wiring platform 133. A second rear end cap 144 is similarly configured to snap into slots 191, 193, of the right wiring platform 133. The rear end cap 143 further has tabs or ribs 161, 163, 167 centrally positioned on its underside surface 162. These ribs 161, 163, 167 are positioned to interact with a projection 168 on the tongue 129 to retain the tongue at a selected position. In one embodiment, causing the projection 168 to reside between ribs 161 and 163 provides for ½" additional extension of the tongue 129, and causing the projection 168 to reside between ribs 163 and 167 provides an additional ½" extension. In one embodiment, the length of the of slot 139 is selected to enable the tongue to extend up to one inch to lengthen the distance between the two wiring platforms 131, 133. A stop 169 is formed on the floor of the wiring platform 133 and stops the tongue 129 from going too far into the wiring platform 133.

In one embodiment, the tongue 129 can move freely in and out, and the length of the overall fixture pair is determined by fastening each wireway platform 131, 133, in place at a desired distance apart. It should be noted that serpentine units as disclosed in FIGS. 14-18 can mate with non-serpentine fixed length linear units such as those disclosed in FIGS. 1-13, for example, where it is necessary to provide a bend or angle between two linear units.

Thus, those skilled in the art will appreciate that various adaptations and modifications of the just described illustrative embodiments can be configured without departing from the scope and spirit of the invention. Therefore, it is to be understood that, within the scope of the appended claims, the invention may be practiced other than as specifically described herein.

What is claimed is:

1. Light fixture apparatus comprising:

a driver housing configured to removably mount an LED driver module;

a circuit board mounting platform having first and second slots and a mounting boss formed on an underside thereof;

the driver housing having feet formed on an upper vertical edge of the driver housing, the feet being configured to respectively insert into the first and second slots and further having a tab extending from an inner side surface thereof, the tab having an aperture therein, the aperture being positioned such that a fastening device is insertable through the aperture and into said mounting boss;

a wiring rail platform having first and second side surfaces, which turn inwardly at their upper ends to respectively form a pivot point and a horizontal support surface, the wiring rail platform further having an angled channel located adjacent the second side surface in an interior portion of said wiring rail platform;

wherein a lower end of a right side of the driver housing has a groove formed therein which is pivotally mountable at the pivot point to facilitate attachment of the driver housing to the wiring platform, the driver housing further having a flat horizontal surface formed at a lower end of a left side of the driver housing positioned to rest on the horizontal support surface of the wiring rail platform.

2. The light fixture apparatus of claim 1 further comprising a circuit board mounted on the circuit board mounting platform, the circuit board carrying one or more LEDs.

3. The light fixture apparatus of claim 2 further comprising a plurality of electrical conductors for providing power from said LED driver to said LEDs.

4. Light fixture apparatus comprising:

a circuit board mounting platform having first and second slots and a mounting boss formed on an underside thereof;

an LED driver unit;

a driver housing having:

(a) a plurality of feet formed on an upper vertical edge thereof, the feet being configured to respectively insert into the first and second slots, (b) a tab extending from an inner side surface thereof, the tab having an aperture therein, the aperture being positioned such that a fastening device is insertable through the aperture and into said mounting boss;

(c) a longitudinal groove formed at one side of a lower end thereof; and (d) a flat horizontal surface formed at a lower end of an opposite side thereof; and a wiring rail platform having first and second side surfaces which turn inwardly at their respective upper ends to respectively form a longitudinal rib and a horizontal support surface, the wiring rail platform further having an angled channel located adjacent the second side surface;

wherein the driver housing is configured to be positioned at an angle to the wiring rail platform with the longitudinal groove pivotally engaged with the longitudinal rib and to thereafter pivot downwardly such that the flat horizontal surface rests on the horizontal support surface of the wiring rail platform.

5. The light fixture apparatus of claim 4 further comprising a fastening device insertable through said opposite side of said driver housing and into the angled channel of the wiring rail platform to attach the driver housing to the wiring rail platform.

6. The light fixture apparatus of claim 4 further comprising a circuit board mounted on the circuit board mounting platform, the circuit board carrying one or more LEDs.

7. The light fixture apparatus of claim 5 further comprising a plurality of electrical conductors for providing power from said LED driver to said LEDs.

8. The light fixture apparatus of claim 7 further comprising a plurality of semicircular heat sink fins formed on an underside of said circuit board mounting platform at opposite ends thereof.

9. The light fixture apparatus of claim 4 wherein said wiring rail platform has a wiring guide channel formed therein which extends the entire length of said platform.

10. The light fixture apparatus of claim 4 wherein the circuit board mounting platform and the driver housing, when attached together, form a module which is attachable anywhere along a length of the wiring rail platform.

11. The light fixture apparatus of claim 9 wherein the circuit board mounting platform and the driver housing, when attached together, form a module which is attachable anywhere along a length of the wiring rail platform.

12. Light fixture apparatus comprising:

a circuit board mounting platform;

a driver housing configured to attach to the circuit board mounting platform and having an LED driver positioned therein;

the driver housing having:

(a) a longitudinal groove formed at one side of a lower end thereof; and (b) a flat horizontal surface formed at a lower end of an opposite side thereof; and a wiring rail platform having first and second side surfaces which turn inwardly at their upper ends to respectively form a longitudinal rib and a horizontal support surface, the wiring rail platform further having an angled channel located adjacent the second side surface;

wherein the driver housing is configured to be positioned at an angle to the wiring rail platform with the longitudinal groove pivotally engaged with the longitudinal rib and to thereafter pivot downwardly such that the flat horizontal surface rests on the horizontal support surface of the wiring rail platform.

13. The light fixture apparatus of claim 12 further comprising a fastening device insertable through said opposite side of said driver housing and into the angled channel of the wiring rail platform to attach the driver housing to the wiring rail platform.

14. The light fixture apparatus of claim 12 further comprising a circuit board mounted on the circuit board mounting platform, the circuit board carrying one or more LEDs.

15. The light fixture apparatus of claim 14 further comprising a plurality of electrical conductors for providing power from said LED driver to said LEDs.

16. The light fixture apparatus of claim 15 further comprising a plurality of semicircular heat sink fins formed on an underside of said circuit board mounting platform at opposite ends thereof.

17. The light fixture apparatus of claim 12 wherein said wiring rail platform has a wiring guide channel formed therein which extends the entire length of said wiring rail platform.

18. The light fixture apparatus of claim 12 wherein the circuit board mounting platform and the driver housing, when attached together, form a module which is attachable anywhere along a length of the wiring rail platform.

19. The light fixture apparatus of claim 17 wherein the circuit board mounting platform and the driver housing, when attached together, form a module which is attachable anywhere along a length of the wiring rail platform.

20. An electrical pinholder apparatus comprising:

a bottom pinholder comprising upper and lower components removably attachable together and configured to hold first and second insulation piercing pins electrically connected to respective first and second cables running within a wireway, the first and second insulation piercing pins being electrically connected to a vertically downwardly disposed electrical connector;

a top pinholder comprising upper and lower components removably attachable together and configured to hold third and fourth insulation piercing pins electrically connected respectively to first and second input leads of an LED power supply, the third and fourth insulation piercing pins being electrically connected to a vertically upwardly disposed electrical connector; and wherein the vertically downwardly disposed electrical connector and the vertically upwardly disposed electrical connector are configured to mate together to establish an electrical connection therebetween.

* * * * *